US008890414B2

(12) United States Patent
Rowlette, Jr. et al.

(10) Patent No.: US 8,890,414 B2
(45) Date of Patent: Nov. 18, 2014

(54) LIGHTING MODULE

(75) Inventors: John R. Rowlette, Jr., Raleigh, NC (US); Ashish Ekbote, Carpinteria, CA (US); Michael James Harris, Cary, NC (US)

(73) Assignee: Cree, Inc., Durham, NC (US)

( * ) Notice: Subject to any disclaimer, the term of this patent is extended or adjusted under 35 U.S.C. 154(b) by 243 days.

(21) Appl. No.: 13/435,783

(22) Filed: Mar. 30, 2012

(65) Prior Publication Data

US 2012/0262065 A1 Oct. 18, 2012

Related U.S. Application Data

(60) Provisional application No. 61/470,771, filed on Apr. 1, 2011.

(51) Int. Cl.

| | |
|---|---|
| ***H05B 37/02*** | (2006.01) |
| ***H05B 33/08*** | (2006.01) |
| ***F21V 23/02*** | (2006.01) |
| ***F21S 8/02*** | (2006.01) |
| *F21Y 101/02* | (2006.01) |
| *F21V 29/00* | (2006.01) |
| *F21V 23/06* | (2006.01) |

(52) U.S. Cl.

CPC ..... *H05B 33/0806* (2013.01); *F21Y 2101/02* (2013.01); *H05B 33/0884* (2013.01); *F21V 29/2225* (2013.01); *F21V 23/06* (2013.01); *F21V 23/02* (2013.01); *F21V 29/2262* (2013.01); *F21S 8/026* (2013.01); *H05B 33/0842* (2013.01)

USPC ..... 315/113; 315/291

(58) Field of Classification Search

CPC ..... H05B 37/02

USPC ..... 315/200 R, 113, 294, 307

See application file for complete search history.

(56) References Cited

U.S. PATENT DOCUMENTS

| | | | | |
|---|---|---|---|---|
| 8,441,210 | B2 * | 5/2013 | Shteynberg et al. | 315/308 |
| 8,491,159 | B2 * | 7/2013 | Recker et al. | 362/276 |

(Continued)

FOREIGN PATENT DOCUMENTS

| | | | |
|---|---|---|---|
| DE | 102007026867 | A1 | 10/2008 |
| DE | 102010031247 | A1 | 9/2011 |
| EP | 2213932 | A1 | 8/2010 |
| WO | 2011033415 | A1 | 3/2011 |

OTHER PUBLICATIONS

International Search Report and Written Opinion for PCT/US2012/031493 mailed Jul. 19, 2012, 11 pages.

(Continued)

*Primary Examiner* — Don Le

(74) *Attorney, Agent, or Firm* — Withrow & Terranova, P.L.L.C.

(57) ABSTRACT

The present disclosure relates to a lighting module wherein a DC-DC converter and an LED module are provided as an integral part of the lighting module, and an AC-DC module is provided separately from the lighting module. The AC-DC module is effectively a remote power supply that can be easily replaced without having to replace, reconfigure, or otherwise modify the lighting module. With this configuration, the DC-DC module may be tuned for the particular LED module of the lighting module, and in the case of a failure of the AC-DC module, the AC-DC module can be replaced without having to replace or retune the DC-DC module.

31 Claims, 10 Drawing Sheets

(56) References Cited

U.S. PATENT DOCUMENTS

| | | | | |
|---|---|---|---|---|
| 2007/0236946 | A1 | 10/2007 | Petrakis et al. | |
| 2008/0018261 | A1 | 1/2008 | Kastner | |
| 2009/0184616 | A1 | 7/2009 | Van De Ven et al. | |
| 2013/0148337 | A1* | 6/2013 | Chen et al. | 362/158 |
| 2013/0155392 | A1* | 6/2013 | Barrilleaux et al. | 356/121 |
| 2013/0214697 | A1* | 8/2013 | Archenhold | 315/291 |
| 2013/0264943 | A1* | 10/2013 | Bora et al. | 315/113 |
| 2014/0001974 | A1* | 1/2014 | Lu et al. | 315/201 |

OTHER PUBLICATIONS

International Preliminary Report on Patentability for PCT/US2012/031493, mailed Oct. 10, 2013, 7 pages.

* cited by examiner

LIGHTING MODULE

This application claims the benefit of U.S. provisional patent application No. 61/470,771 filed Apr. 1, 2011, the disclosure of which is incorporated herein by reference in its entirety.

FIELD OF THE DISCLOSURE

The present disclosure relates to lighting modules.

BACKGROUND

In recent years, a movement has gained traction to replace incandescent light bulbs with lighting fixtures that employ more efficient lighting technologies. One such technology that shows tremendous promise employs light emitting diodes (LEDs). Compared with incandescent bulbs, LED-based light fixtures are much more efficient at converting electrical energy into light and are longer lasting, and as a result, lighting fixtures that employ LED technologies are expected to replace incandescent bulbs in residential, commercial, and industrial applications.

As such, there is need for LED based lighting fixtures that are capable of being employed in an efficient and economical manner in residential, commercial, and industrial applications.

SUMMARY

The present disclosure relates to a lighting module wherein a DC-DC converter and an LED module are provided as an integral part of the lighting module, and an AC-DC module is provided separately from the lighting module. The AC-DC module is effectively a remote power supply that can be easily replaced without having to replace, reconfigure, or otherwise modify the lighting module. With this configuration, the DC-DC module may be tuned for the particular LED module of the lighting module, and in the case of a failure of the AC-DC module, the AC-DC module can be replaced without having to replace or retune the DC-DC module.

In one embodiment, a lighting module is mounted within a mounting housing and receives DC power from a remote AC-DC module that is mounted outside of the mounting housing. The lighting module includes an LED module comprising a plurality of LEDs and a DC-DC module. The DC-DC module is configured to receive a DC power signal from the remote AC-DC module and provide at least one drive signal to drive the plurality of LEDs of the LED module.

In this embodiment, the lighting module may be configured to receive from the remote AC-DC module an output dimming signal based on a desired level of dimming for the plurality of LEDs, wherein the DC-DC module is configured to control the at least one drive signal based on the output dimming signal. The LED module is configured to provide a feedback signal to the DC-DC module, which is further configured to control the at least one drive signal based at least in part on the feedback signal. For example, the LED module is configured to detect a fault or temperature associated with the LED module and the feedback signal relates to the fault or temperature associated with the LED module.

In another embodiment, the DC-DC module is configured to provide a feedback signal to the remote AC-DC module, which is further configured to control the DC power supply based at least in part on the feedback signal. The DC-DC module is configured to detect a fault or temperature associated with the DC-DC module and the feedback signal relates to the fault or the temperature associated with the DC-DC module.

In another embodiment, the remote AC-DC module is configured to generate and provide to the DC-DC module an output dimming signal based at least in part on the feedback signal, and the DC-DC module is configured to control the at least one drive signal based on the output dimming signal. The remote AC-DC module may be configured to generate the output dimming signal based on an input dimming signal that is separate from the AC power signal. Alternately, the remote AC-DC module may be configured to generate the output dimming signal based on a characteristic of the AC power signal.

In yet another embodiment, a lighting assembly is provided that includes a lighting module and an AC-DC module that is located remotely from the lighting module. The lighting module includes an LED module having a plurality of LEDs and a DC-DC module. The DC-DC module may be configured to receive a DC power signal and to provide at least one drive signal to drive the plurality of LEDs of the LED module. The AC-DC module may be configured to convert an AC power signal to the DC power signal for the DC-DC module. The lighting module is configured to be mounted inside of a mounting housing and the AC-DC module is configured to be mounted outside of the mounting housing. The resultant lighting assembly may include a mounting frame, wherein the mounting housing is mounted to the mounting frame and the lighting assembly forms a recessed lighting fixture for ceilings. The lighting assembly may further include a junction box mounted on the mounting frame and outside of the mounting housing, wherein the AC-DC module is mounted inside the junction box and the lighting module is mounted inside the mounting housing.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

Figure 1:
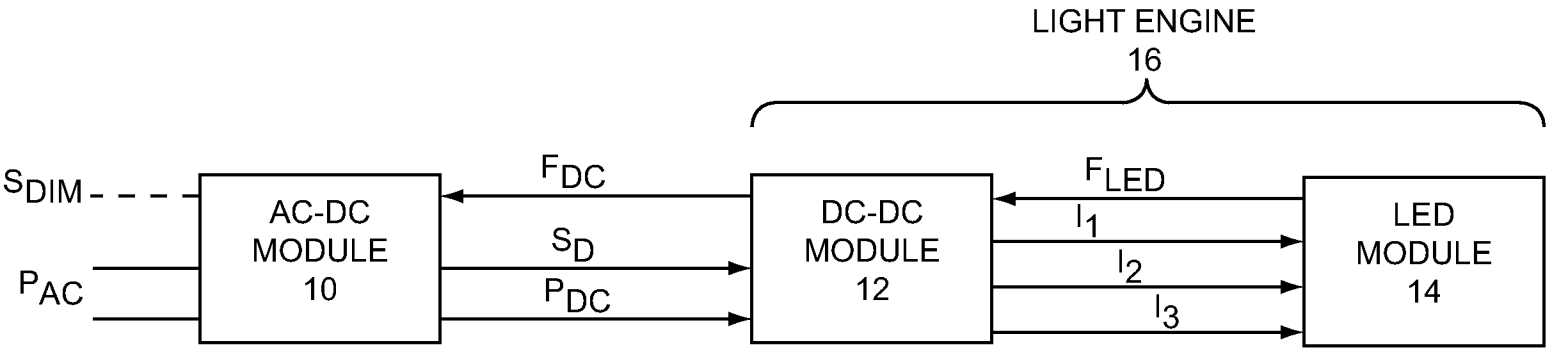
FIG. 1 is a block diagram of electronics employed for a lighting fixture according to one embodiment of the disclosure.

With reference to FIG. 1, the electronics for one embodiment of the disclosed lighting fixture are illustrated. As shown, the electronics include an AC-DC (alternating current-direct current) module 10, a DC-DC (direct current-direct current) module 12, and an LED (light emitting diode) module 14. The DC-DC module 12 and the LED module 14 cooperate to form a light engine 16, wherein the DC-DC module 12 generates the requisite drive currents $I_N$ to drive corresponding strands of LEDs provided by the LED module 14. The DC-DC module 12 is powered and controlled in part by the AC-DC module 10.

The AC-DC module 10 is configured to receive an AC power supply signal $P_{AC}$ and a input dimming signal $S_{DIM}$, and based on these signals, provide a DC power supply signal $P_{DC}$ and an output dimming signal $S_D$ to the DC-DC module 12. The AC-DC module 10 includes circuitry to step down and rectify the AC power supply signal $P_{AC}$ to a desired DC voltage, which represents the DC power supply signal $P_{DC}$. The DC power supply signal $P_{DC}$ is used to power the DC-DC module 12.

The input dimming signal $S_{DIM}$ is an analog or digital control signal that represents a desired level of dimming relative to a maximum desirable lumen output of an LED module 14. The input dimming signal $S_{DIM}$ may be provided from an appropriate remote control module or lighting switch (not shown), as will be appreciated by those skilled in the art. The AC-DC module 10 provides the necessary circuitry to process the input dimming signal $S_{DIM}$ and generate a corresponding output dimming signal $S_D$ based on the desired level of dimming. As will be appreciated by one skilled in the art, the output dimming signal $S_D$ is generally a pulse width modulated (PWM) signal wherein the duty cycle of the output dimming signal $S_D$ is effectively a function of the input dimming signal $S_{DIM}$. Since the input dimming signal $S_{DIM}$ corresponds to a desired level of dimming, the duty cycle of the output dimming signal $S_D$ is a function of the desired level of dimming.

In an alternative embodiment, the AC power supply signal $P_{AC}$ may be provided with the use of a dimmer for lighting control. The dimmer may be leading or trailing edge controlled. The portion of the AC waveform received in the AC power supply signal $P_{AC}$ corresponds to the desired level of dimming. As such, the AC-DC module 10 is configured to analyze the AC power supply signal $P_{AC}$ and generate the output signal $S_D$ based thereon.

The DC-DC module 12 includes a DC-DC converter and multiple current sources that are supplied by the DC-DC converter. The current sources generate the individual drive currents $I_N$, which are illustrated as $I_1$, $I_2$, and $I_3$, and are used to respectively drive three different strands of LEDs of the LED module 14. The DC-DC converter of the DC-DC module 12 is configured to drive the current sources to control the drive currents $I_1$, $I_2$, and $I_3$ such that the respective strands of LEDs output light at a desired color as well as a desired intensity based on the output dimming signal $S_D$. In one embodiment, one or more strands may be formed from red LEDs, while one or more of the other strands may be formed from blue-shifted yellow LEDs. The different strands are driven by the drive currents $I_1$, $I_2$, and $I_3$ such that the light emitted from the strands mixes to form light at a desired color temperature as well as at a desired intensity based on the desired level of dimming.

The DC-DC module 12 may be configured to provide one or more feedback signals $F_{DC}$ to the AC-DC module 10. The feedback signals $F_{DC}$ may provide temperature, fault, or other information bearing on the operation of the DC-DC module 12, and the AC-DC module 10 may be configured to respond to the feedback signals $F_{DC}$ and adjust or control the output dimming signal $S_D$, the DC power supply signal $P_{DC}$, or both, in a desired manner. Similarly, the LED module 14 may be configured to provide one or more feedback signals $F_{LED}$ to the DC-DC module 12. The feedback signals $F_{LED}$ may provide temperature, fault, or other information bearing on the operation of the LED module 14, and the DC-DC module 12 may be configured to respond to the feedback signals $F_{LED}$ and adjust or control the drive currents $I_N$ in a desired manner.

Figure 2:
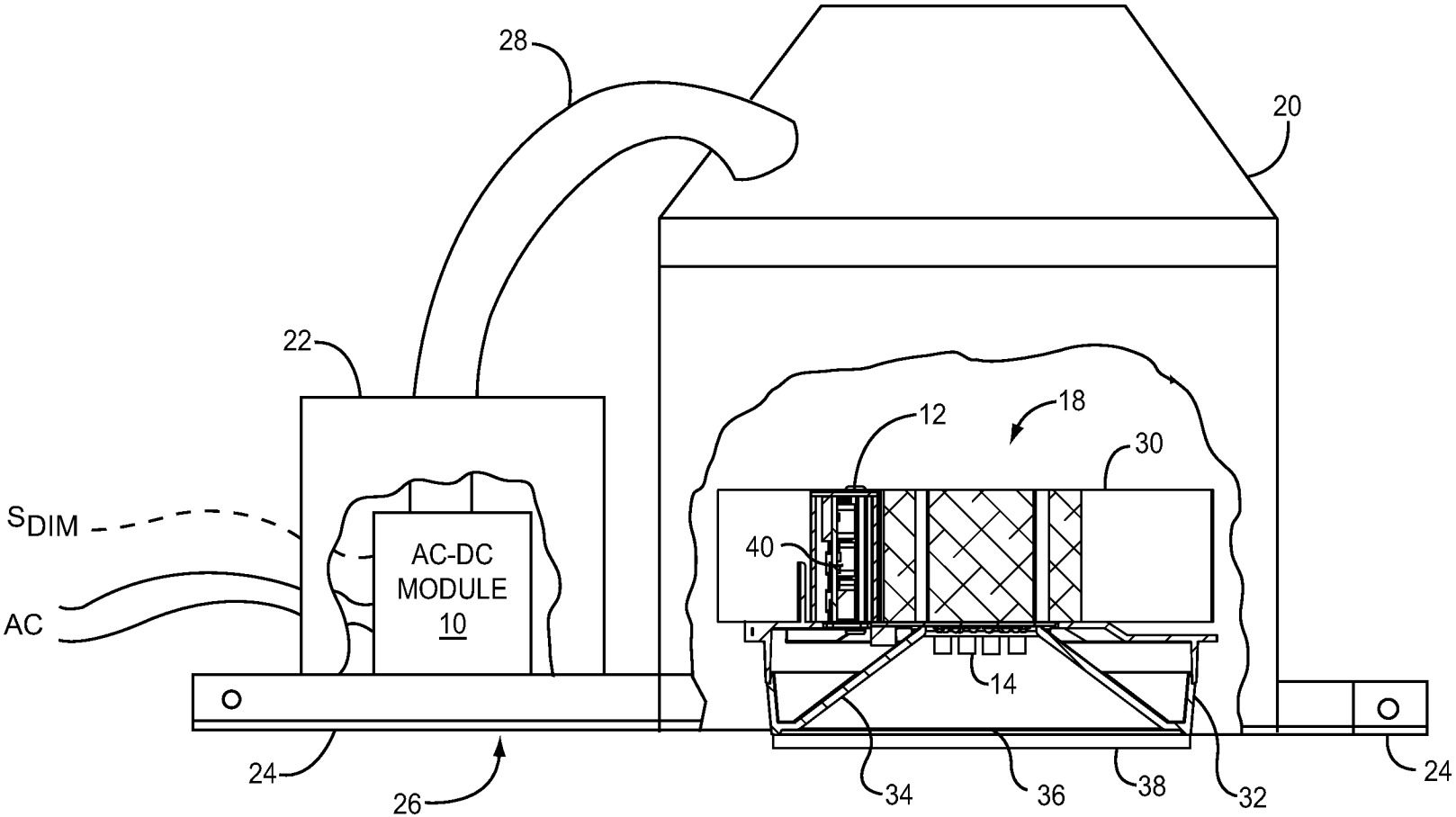
FIG. 2 illustrates a mounting assembly in which the lighting fixture of FIG. 1 is provided.

For the present disclosure, the DC-DC module 12 and the LED module 14 of the light engine 16 are provided in a lighting module 18, while the AC-DC module 10 is designed to be mounted apart from the lighting module 18, as shown in FIG. 2. As illustrated, the lighting module 18 is mounted inside of a mounting housing 20, while the AC-DC module 10 is mounted outside of the mounting housing 20. In particular, the AC-DC module 10 is mounted to or inside a junction box 22. The mounting housing 20 and the junction box 22 may be coupled together via a mounting frame 24 to form a mounting assembly 26. For example, the mounting frame 24 of the mounting assembly 26 may be configured as a recessed lighting assembly, which mounts between adjacent ceiling joists such that the mounting housing 20 is suspended at a location where the lighting module 18 is desired. A cable 28 is used to connect the AC-DC module 10 and the DC-DC module 12. The cable 28 is shown running from the AC-DC module 10 to the lighting module 18 through an upper portion of the mounting housing 20. The cable 28 may be provided in a conduit in select embodiments.

The DC-DC module 12 and the LED module 14 are mounted to or in portions of the lighting module 18. In addition to the DC-DC module 12 and the LED module 14, the lighting module 18 comprises a heat sink 30, a support bracket 32, a mixing chamber 34 having a reflective interior, a diffuser 36, and a lens 38. In the illustrated embodiment, the heat sink 30 provides for a compartment 40 in which the DC-DC module 12 is mounted. As such, the DC-DC module 12 is mounted within the confines of the outer boundaries of the heat sink 30.

In this embodiment, the LED module 14 is mounted to the heat sink 30 wherein a thermal pad (not shown) may be used to thermally couple the LED module 14 to the heat sink 30. The thermal pad may be formed from any thermally conductive material, such as metal or thermally conductive resins. Bolts or other fastening mechanisms may be used to attach the LED module 14 and the thermal pad to a forward surface of the heat sink 30. Notably, the LED module 14 is illustrated as a printed circuit board (PCB) having the LEDs of the different strands of LEDs arranged in an array. A cable assembly is used to connect the LED module 14 to the DC-DC module 12.

The support bracket 32 is a primary structural component for the lighting module 18. The support bracket 32 has a bottom rim, which forms a rear opening and mounts to the heat sink 30 with bolts, such that at least the array of LEDs of the LED module 14 are exposed though the rear opening. In the illustrated embodiment, the rear opening of the support bracket 32 is sized and shaped to correspond to and receive the PCB of the LED module 14. The support bracket 32 also has a forward opening, which receives the mixing chamber 34. The mixing chamber 34 may take various forms. In the illustrated embodiment, the mixing chamber 34 has a conical or parabolic body with a rear opening that is sized and shaped such that the array of LEDs of the LED module 14 remains exposed. The mixing chamber 34 also has a forward opening formed by a forward flange. The mixing chamber 34 concentrically resides inside the support bracket 32 wherein the rear surface of the forward flange of the mixing chamber 34 rests on the forward surface of the support bracket's forward flange.

A planar diffuser 36, which generally corresponds in shape and size to the outside periphery of the forward flange of the mixing chamber 34, may be placed on the forward surface of the forward flange of the mixing chamber 34, and thus cover the forward opening of the mixing chamber 34. The degree and type of diffusion provided by the diffuser 36 may vary from one embodiment to another. Further, color, translucency, or opaqueness of the diffuser 36 may vary from one embodiment to another. Diffusers 36 are typically formed from a polymer or glass, but other materials are viable. Similarly, a planar lens 38, which generally corresponds to the shape and size of the diffuser 36 as well as the outside periphery of the forward flange of the mixing chamber 34, may be placed over the diffuser 36. As with the diffuser 36, the material, color, translucency, or opaqueness of the lens 38 may vary from one embodiment to another. Further, both the diffuser 36 and the lens 38 may be formed from one or more materials or one or more layers of the same or different materials. While only one diffuser 36 and one lens 38 are depicted, the lighting module 18 may have multiple diffusers 36 or lenses 38; no diffuser 36, no lens 38, no diffuser 36 or lens 38, or an integrated diffuser and lens (not shown) in place of the illustrated diffuser 36 and lens 38.

A retention ring may be provided to hold the mixing chamber 34, diffuser 36, and lens 38 in place. In operation, light emitted from the array of LEDs of the LED module 14 is mixed inside the mixing chamber 34 and directed out through the lens 38 in a forward direction to form a light beam. As noted, the array of LEDs of the LED module 14 may include LEDs that emit different colors of light. For example, the array of LEDs may include both red LEDs that emit red light and blue-shifted yellow or green LEDs that emit bluish-yellow or bluish green light, wherein the red and bluish-yellow or bluish-green light is mixed to form "white" light at a desired color temperature. For a uniformly colored light beam, relatively thorough mixing of the light emitted from the array of LEDs is desired. Both the mixing chamber 34 and the diffuser 36 play a role in mixing the light emanated from the array of LEDs of the LED module 14.

Certain light rays, which are referred to as non-reflected light rays, emanate from the array of LEDs of the LED module 14 and exit the mixing chamber 34 through the diffuser 36 and lens 38 without being reflected off of the interior surface of the mixing chamber 34. Other light rays, which are referred to as reflected light rays, emanate from the array of LEDs of the LED module 14 and are reflected off of the reflective interior surface of the mixing chamber 34 one or more times before exiting the mixing chamber 34 through the diffuser 36 and lens 38. With these reflections, the reflected light rays are effectively mixed with each other and at least some of the non-reflected light rays within the mixing chamber 34 before exiting the mixing chamber 34 through the diffuser 36 and the lens 38. The diffuser 36 functions to diffuse, and as result mix, the non-reflected and reflected light rays as they exit the mixing chamber 34, wherein the mixing chamber 34 and the diffuser 36 provide sufficient mixing of the light emanated from the array of LEDs of the LED module 14 to provide a light beam of a consistent color. In addition to mixing light rays, the diffuser 36 is designed and the mixing chamber 34 shaped in a manner to control the relative concentration and shape of the resulting light beam that is projected from the diffuser 36 and the lens 38. For example, a first lighting module 18 may be designed to provide a concentrated beam for a spotlight, wherein another may be designed to provide a widely dispersed beam for a floodlight. Notably, finishing trim (not shown) may also be provided to further contribute to light mixing, beam shaping, or both. The interior surface of the finishing trim may range from a highly reflective metal coating to a matte black finish, depending on the desired aesthetics and functionality.

Figure 3A:
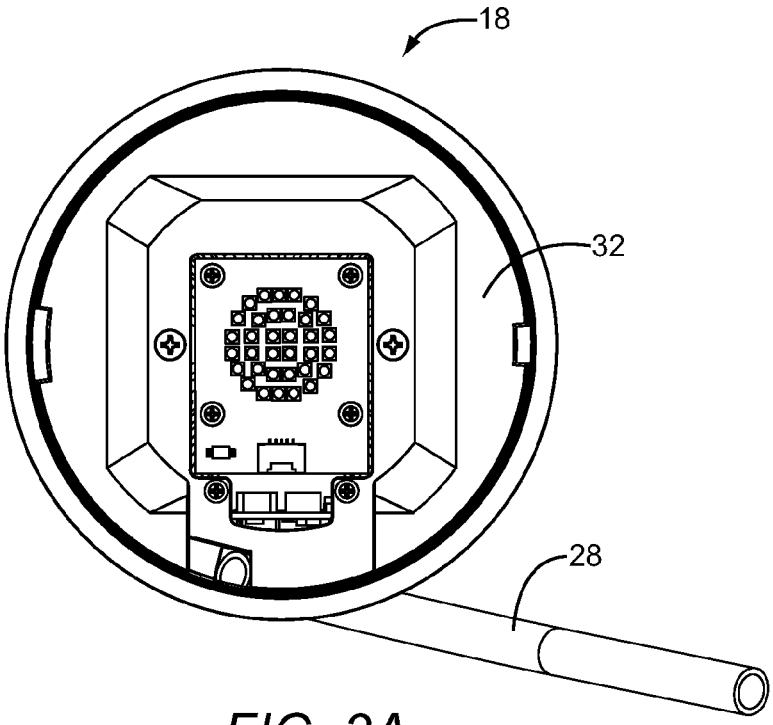
FIGS. 3A through 3G are various views of a lighting module for the lighting fixture of FIG. 1 according to one embodiment of the disclosure.
Figure 3B:
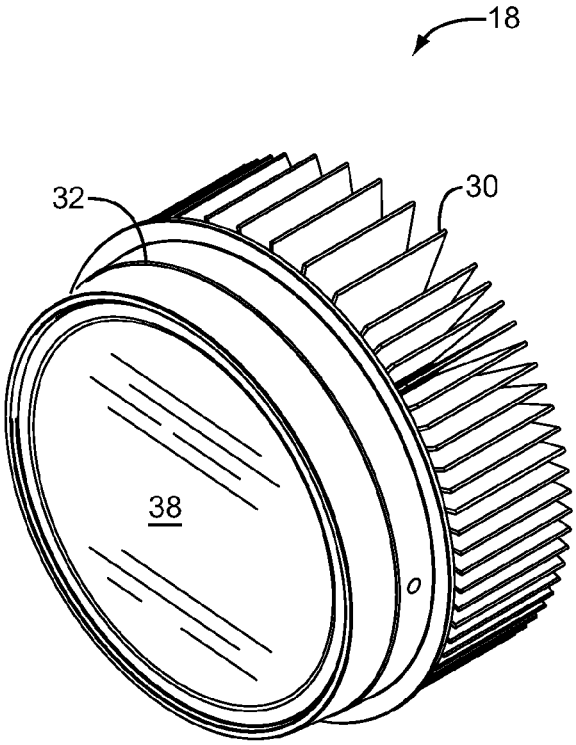
Figure 3C:
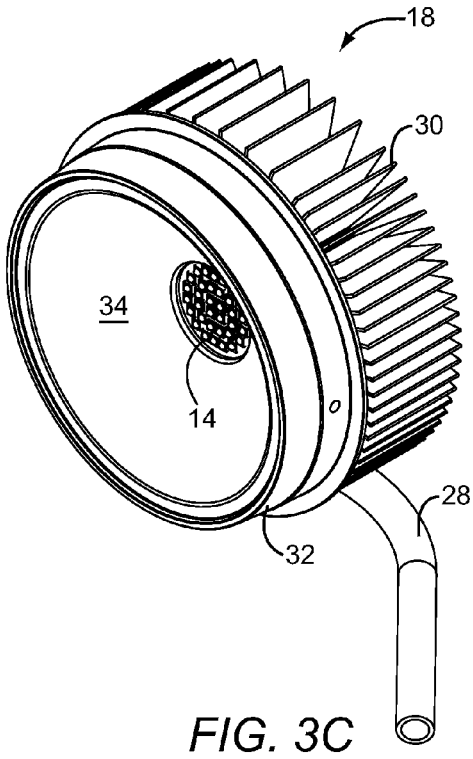
Figure 3D:
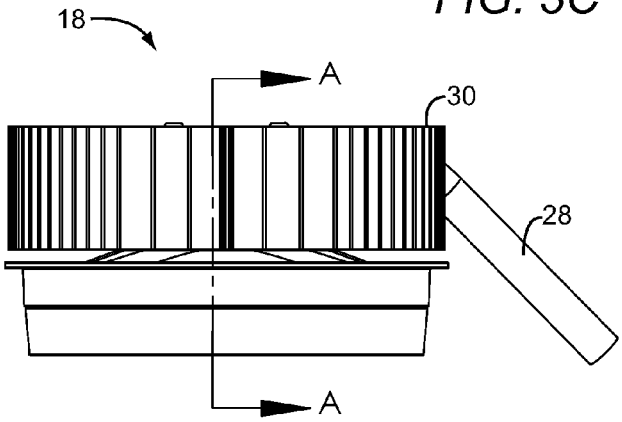
Figure 3E:
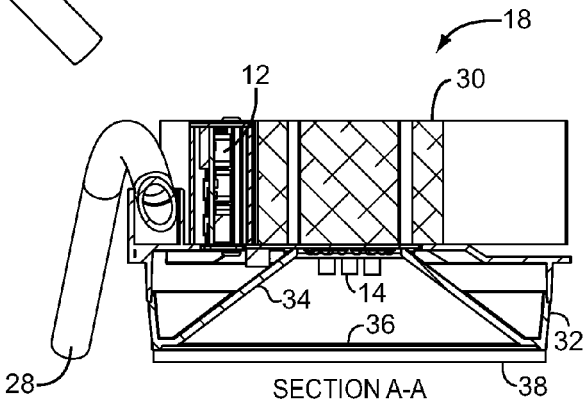
Figure 3F:
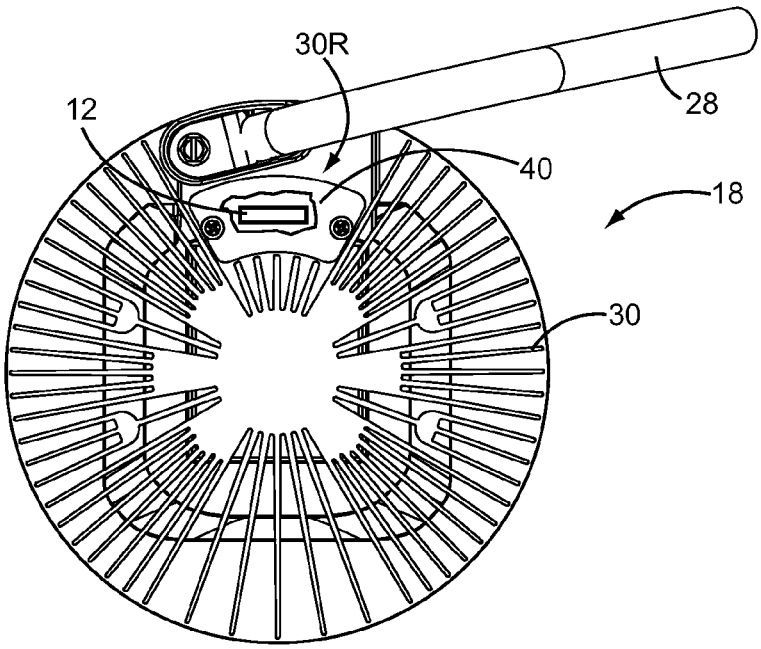
Figure 3G:
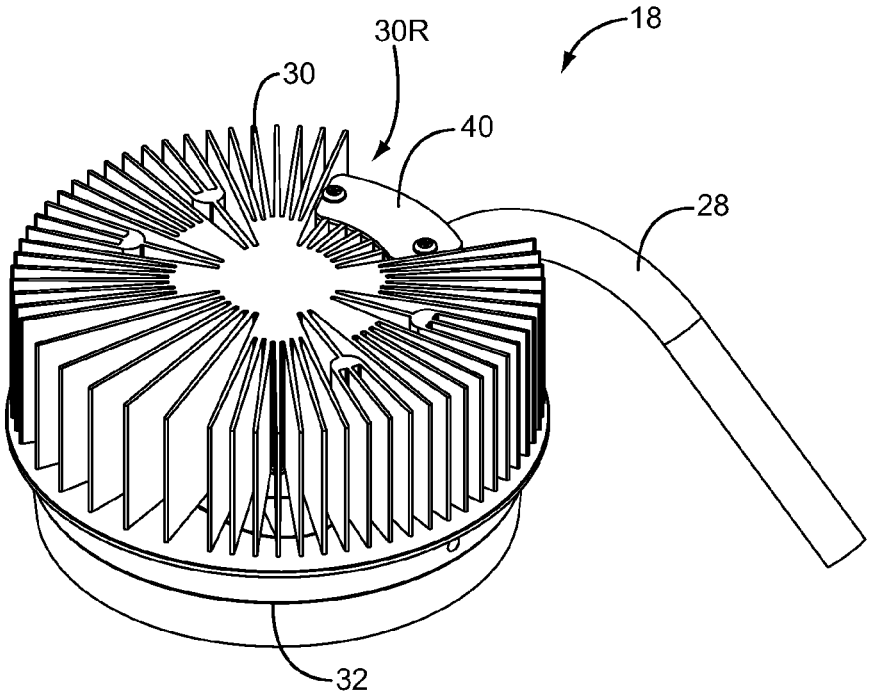
Figure 4A:
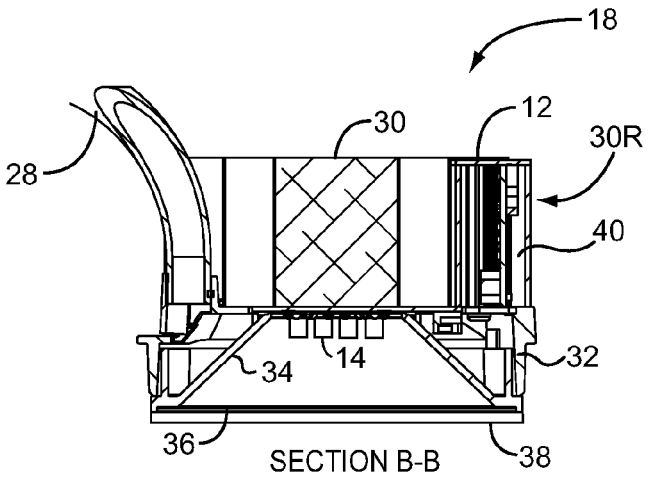
FIGS. 4A through 4G are various views of a lighting module for the lighting fixture of FIG. 1 according to one embodiment of the disclosure.
Figure 4B:
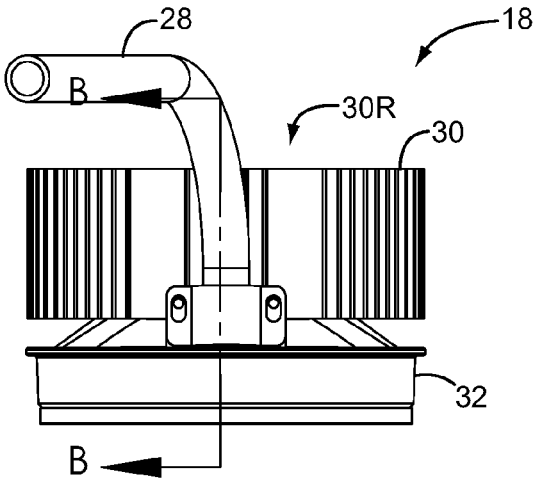
Figure 4C:
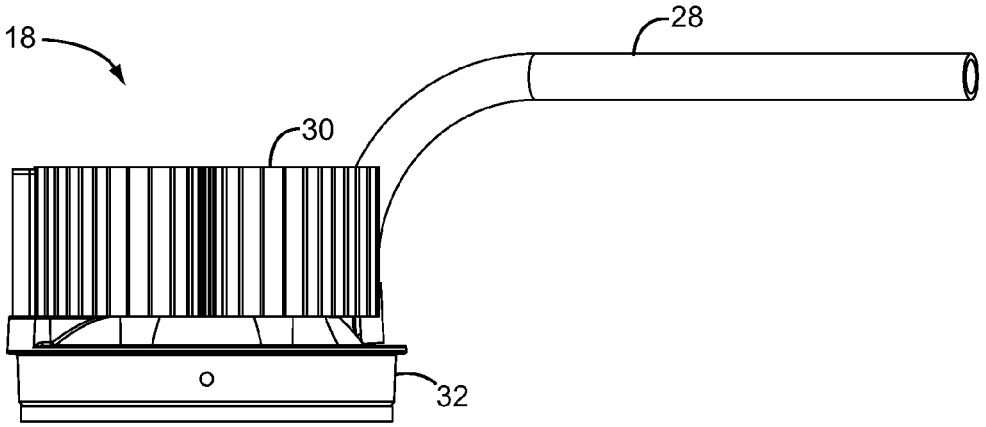
Figure 4D:
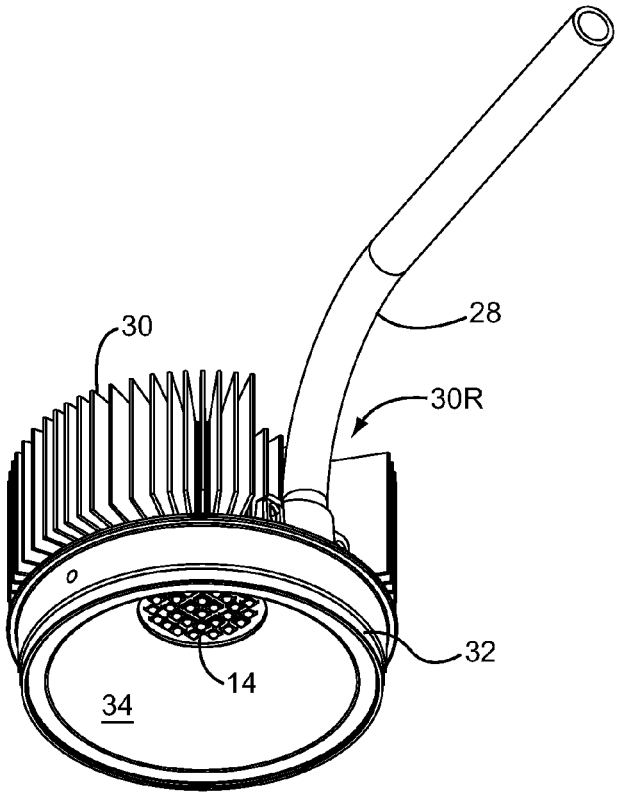
Figure 4E:
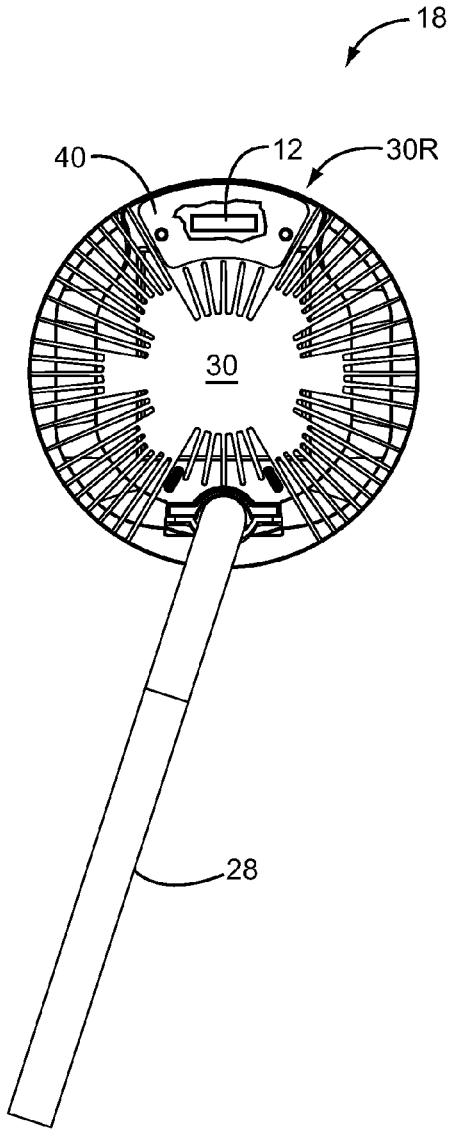
Figure 4F:
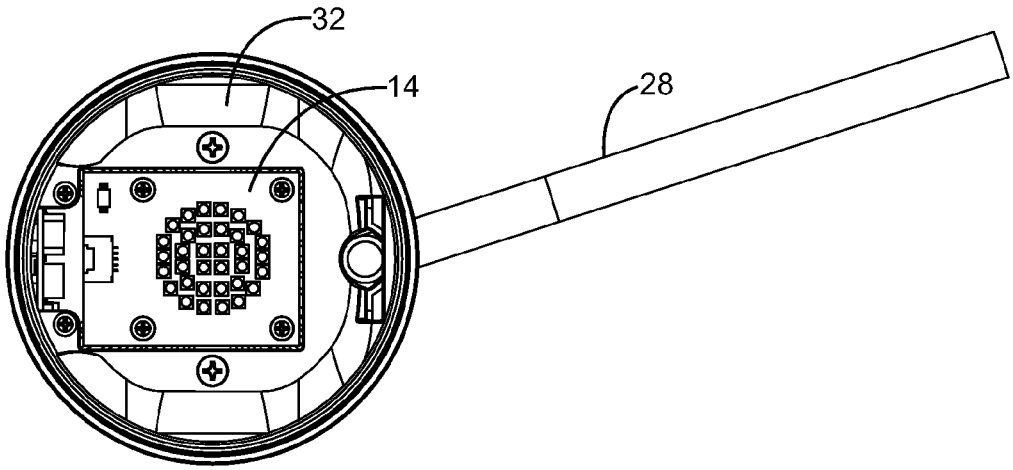
Figure 4G:
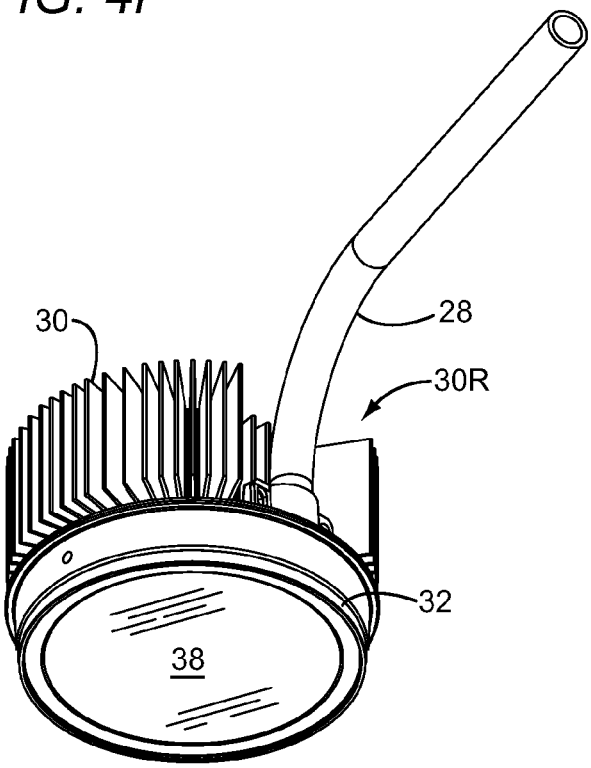

FIGS. 3A through 3G and FIGS. 4A through 4G respectively illustrate various views of two embodiments of the disclosure. In these embodiments and as described in further detail below, the side(s) of the heat sink 30 may be formed to have recessed portions 30R that extend from the forward surface of the heat sink 30 to the rear surface of the heat sink 30. A compartment 40 may be provided in and along one of the recessed portions 30R of the heat sink 30, such that the compartment 40 does not extend past the overall lateral dimensions of the heat sink 30. As clearly depicted in FIGS. 3F and 3G, the compartment 40 may be provided by a separate housing that mounts to the heat sink 30 and resides substantially or entirely within a recessed portion 30R. The housing may optionally have a bottom and a detachable lid, such that the DC-DC module 12 is protected from the elements. FIGS. 3F, 3G, and 4E illustrate the lid being in place on the compartment 40. FIGS. 3F and 4E illustrate the DC-DC module 12 being located inside of the compartment 40 through a cut-away provided in the lid of the compartment 40. Alternatively, the main body of the compartment 40 may be formed as an integral part of the heat sink 30 and be configured to receive the optional lid.

As illustrated in FIGS. 4A through 4G, the cable 28, as well as any conduit in which the cable 28 is run, may also be configured to exit the support bracket 32 adjacent a recessed portion 30R of the heat sink 30. As such, the cable 28 may run through the recessed portion 30R and within the outer periphery of the heat sink 30.

In select embodiments, the support bracket 32 is configured to form an air gap between the fins of the heat sink 30 and the main body of the support bracket 32 to provide for additional airflow through the fins of the heat sink 30.

Figure 5A:
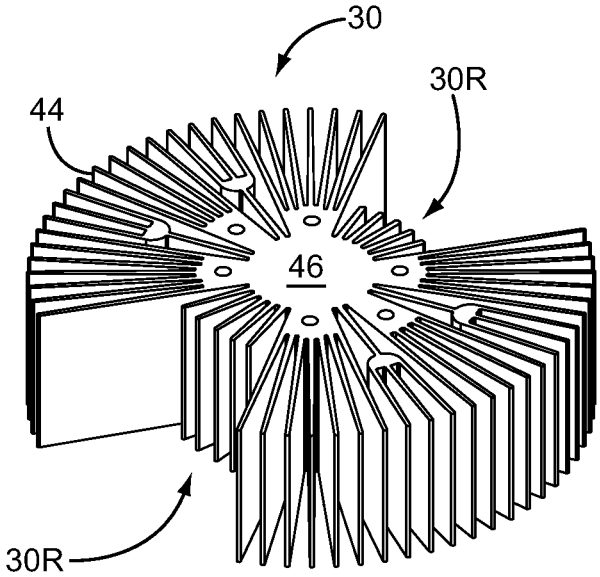
FIGS. 5A and 5B are isometric views of the heat sinks for the embodiments illustrated in FIGS. 3A through 3G and FIGS. 4A through 4G, respectively.
Figure 5B:
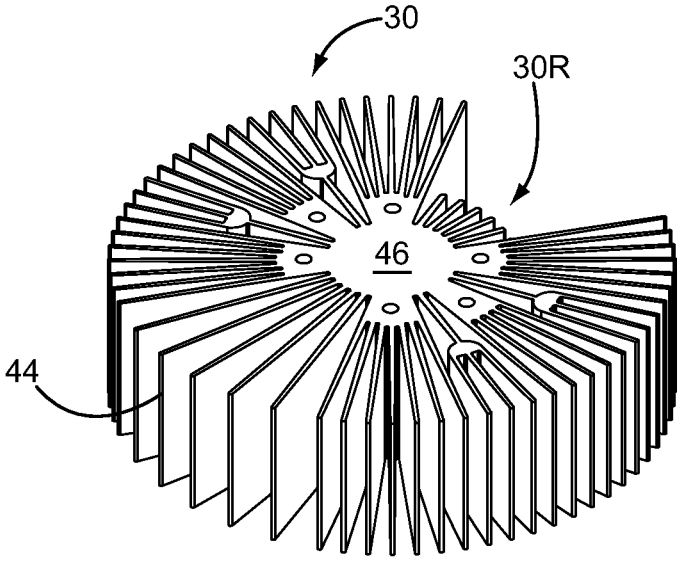

FIGS. 5A and 5B illustrate the heat sinks 30 and the respective recessed portions 30R for the respective embodiments. The heat sinks 30 include radial fins 44 that are substantially parallel to a central axis of the substantially cylindrical heat sink 30. In the illustrated embodiments, shorter fin sections have a group of adjacent radial fins 44, which radially extend to a first distance relative to the central axis of the heat sink 30. The shorter fin sections that correspond to the recessed portion 30R are provided among or between one or more longer fin sections. As illustrated, the embodiment of FIG. 5A has two shorter fin sections, and thus, two recessed portions 30R. The embodiment of FIG. 5B has one shorter fin section, and thus one recessed portion 30R. The number of shorter and longer fins sections may vary from one embodiment to the next.

The longer fin sections have a group of adjacent radial fins, which radially extend to a second distance relative to the central axis of the heat sink 30, wherein the second distance is greater than the first distance. Relative to the longer fin sections, the shorter fin sections effectively form the recessed portions 30R. While only longer and shorter fin sections are illustrated, one or more intermediate fin sections (not illustrated) may be provided wherein the intermediate fin sections (not shown) have a group of adjacent radial fins, which radially extend to a third distance relative to the central axis of the heat sink 30, wherein the third distance is between the first and second distances.

As noted above, the recessed portions 30R of the heat sink 30 provide channels in which the compartment 40 for the DC-DC module 12 may be formed or mounted. The recessed portions 30R may also act as cable chases.

As illustrated in FIGS. 5A and 5B, the heat sink 30 may include a solid, generally cylindrical core 46, wherein the center axis of the heat sink 30 generally corresponds to the center axis of the core 46. The radial fins 44 effectively extend outward from the outer surface of the cylindrical core 46, wherein the cylindrical core 46 and the radial fins 44 form the heat sink 30. In alternate embodiments, the core 46 may be hollow or have one or more openings or cavities therein. Threaded mounting holes may be formed on the forward and rear surfaces or the fins of the heat sink 30 to facilitate attaching elements, such as the support bracket 32, LED module 14, the compartment 40, and the like. In one embodiment, the entirety of the heat sink 30 is extruded as a single integrated component from highly thermally conductive metal, such as aluminum, copper, gold, or the like. As noted, the compartment 40 that may be used to house the DC-DC module 12 may by integrally formed with the heat sink 30 or may be formed in a separate housing that is mounted to the heat sink 30, and perhaps in a recessed portion 30R provided therein.

Figure 6A:
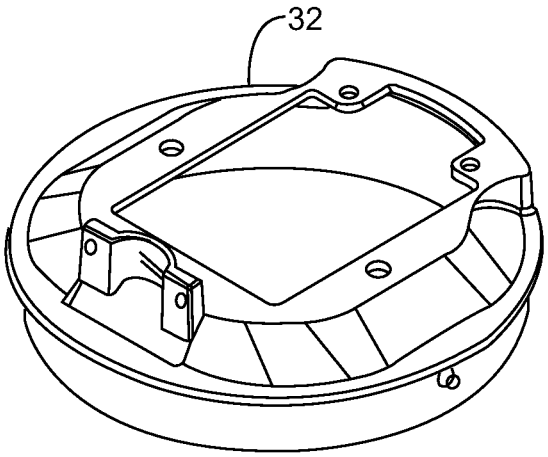
FIGS. 6A and 6B are isometric views of the housings for the embodiments illustrated in FIGS. 3A through 3G and FIGS. 4A through 4G, respectively.
Figure 6B:
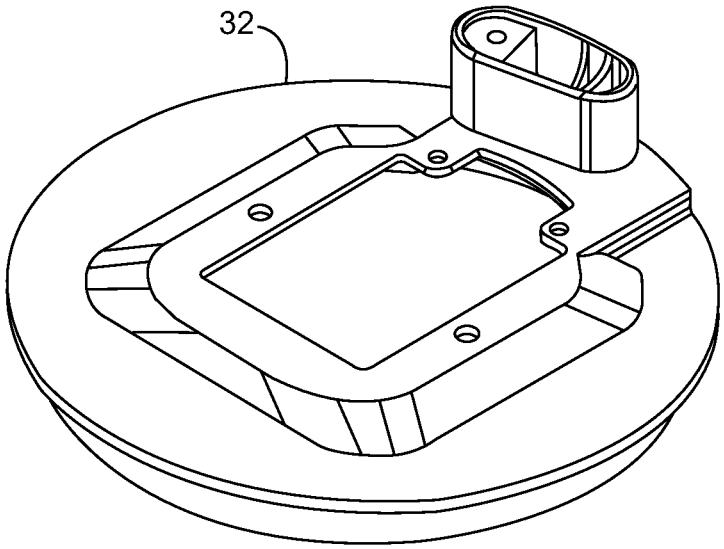

FIGS. 6A and 6B illustrate exemplary support brackets 32 for the respective embodiments.

Those skilled in the art will recognize improvements and modifications to the embodiments of the present disclosure. For example, although the above embodiments are directed to a lighting module 18 and a remote AC-DC module 10 wherein the primary components of the lighting module 18 are substantially cylindrical in nature; however, any one or all of these components may take on other forms, such as rectangular, triangular, elliptical, and the like. As another example, the DC-DC module 12 may be integrated with the LED module 14. All such improvements and modifications are considered within the scope of the concepts disclosed herein.

What is claimed is:

1. A lighting module for mounting within a mounting housing and receiving DC power from a remote AC-DC module that is mounted outside of the mounting housing comprising:

an LED module comprising a plurality of LEDs; and a DC-DC module configured to receive a DC power signal from the remote AC-DC module and provide at least one drive signal to drive the plurality of LEDs of the LED module.

2. The lighting module of claim 1 wherein the DC-DC module is configured to receive from the remote AC-DC module an output dimming signal based on a desired level of dimming for the plurality of LEDs and the DC-DC module is configured to control the at least one drive signal based on the output dimming signal.

3. The lighting module of claim 1 wherein the LED module is configured to provide a feedback signal to the DC-DC module, which is further configured to control the at least one drive signal based at least in part on the feedback signal.

4. The lighting module of claim 3 wherein LED module is configured to detect a temperature associated with LED module and the feedback signal relates to the temperature associated with the LED module.

5. The lighting module of claim 3 wherein LED module is configured to detect a fault in the LED module and the feedback signal relates to the fault associated with the LED module.

6. The lighting module of claim 1 wherein the DC-DC module is configured to provide a feedback signal to the remote AC-DC module, which is further configured to control the DC power signal based at least in part on the feedback signal.

7. The lighting module of claim 6 wherein the DC-DC module is configured to detect a temperature associated with the DC-DC module and the feedback signal relates to the temperature associated with the DC-DC module.

8. The lighting module of claim 6 wherein the DC-DC module is configured to detect a fault in the DC-DC module and the feedback signal relates to the fault associated with the DC-DC module.

9. The lighting module of claim 6 wherein the remote AC-DC module is configured to generate and provide to the DC-DC module an output dimming signal based at least in part on the feedback signal, and the DC-DC module is configured to control the at least one drive signal based on the output dimming signal.

10. The lighting module of claim 9 wherein the remote AC-DC module is configured to convert an AC power signal to the DC power signal and generate the output dimming signal based on an input dimming signal that is separate from the AC power signal.

11. The lighting module of claim 9 wherein the remote AC-DC module is configured to convert an AC power signal to the DC power signal and generate the output dimming signal based on a characteristic of the AC power signal.

12. The lighting module of claim 1 further comprising a heat sink having a compartment, wherein the DC-DC module is mounted within the compartment.

13. The lighting module of claim 1 wherein the plurality of LEDs comprises a first group of LEDs that emit reddish light and a second group of LEDs that emit bluish-green or bluish-yellow light such that the reddish light and the bluish-green or bluish-yellow light mix to form white light at a desired color temperature.

14. A lighting assembly comprising:

a lighting module comprising:

an LED module comprising a plurality of LEDs; and a DC-DC module configured to receive a DC power signal and provide at least one drive signal to drive the plurality of LEDs of the LED module, and an AC-DC module configured to convert an AC power signal to the DC power signal for the DC-DC module, wherein the lighting module is configured to mount inside of a mounting housing and the AC-DC module is configured to mount outside of the mounting housing.

15. The lighting assembly of claim 14 wherein the AC-DC module is configured to mount inside of a junction box, which is mounted outside of the mounting housing.

16. The lighting assembly of claim 15 further comprising the mounting housing, the junction box, and a mounting frame on which the mounting housing and the junction box are mounted.

17. The lighting assembly of claim 15 further comprising a cable that extends through an opening in the mounting housing, connects the AC-DC module and the DC-DC module, and carries the DC power signal from the AC-DC module to the DC-DC module.

18. The lighting assembly of claim 14 wherein the AC-DC module is configured to generate and provide to the DC-DC module an output dimming signal based on a desired level of dimming for the plurality of LEDs and the DC-DC module is configured to control the at least one drive signal based on the output dimming signal.

19. The lighting assembly of claim 18 wherein the AC-DC module is configured to determine the desired level of dimming for the plurality of LEDs based on an input dimming signal that is separate from the AC power signal.

20. The lighting assembly of claim 18 wherein the AC-DC module is configured to determine the desired level of dimming for the plurality of LEDs based on a characteristic of the AC power signal.

21. The lighting assembly of claim 14 wherein the LED module is configured to provide a feedback signal to the DC-DC module, which is further configured to control the at least one drive signal based at least in part on the feedback signal.

22. The lighting assembly of claim 21 wherein the LED module is configured to detect a temperature associated with LED module and the feedback signal relates to the temperature associated with the LED module.

23. The lighting assembly of claim 21 wherein LED module is configured to detect a fault in the LED module and the feedback signal relates to the fault associated with the LED module.

24. The lighting assembly of claim 14 wherein the DC-DC module is configured to provide a feedback signal to the AC-DC module, which is further configured to control the DC power signal based at least in part on the feedback signal.

25. The lighting assembly of claim 24 wherein the DC-DC module is configured to detect a temperature associated with DC-DC module and the feedback signal relates to the temperature associated with the DC-DC module.

26. The lighting assembly of claim 24 wherein the DC-DC module is configured to detect a fault in the DC-DC module and the feedback signal relates to the fault associated with the DC-DC module.

27. The lighting assembly of claim 24 wherein the AC-DC module is configured to generate and provide to the DC-DC module an output dimming signal based at least in part on the feedback signal, and the DC-DC module is configured to control the at least one drive signal based on the output dimming signal.

28. The lighting assembly of claim 27 wherein the AC-DC module is further configured to generate the output dimming signal based on an input dimming signal that is separate from the AC power signal.

29. The lighting assembly of claim 27 wherein the AC-DC module is further configured to generate the output dimming signal based on a characteristic of the AC power signal.

30. The lighting assembly of claim 14 further comprising a mounting frame and the mounting housing mounted to the mounting frame and wherein the lighting assembly forms a recessed lighting fixture for ceilings.

31. The lighting assembly of claim 30 further comprising a junction box mounted on the mounting frame and outside of the mounting housing, wherein the AC-DC module is mounted inside the junction box and the lighting module is mounted inside the mounting housing.

* * * * *